US012788105B2

(12) United States Patent
Liu et al.

(10) Patent No.: US 12,788,105 B2
(45) Date of Patent: Nov. 10, 2026

(54) SHOCK-ABSORBING SOLE WITH UPPER AND LOWER LAYERED SHEARING AND SHOE

(71) Applicant: ANTA (CHINA) CO., LTD., Fujian (CN)

(72) Inventors: Yilong Liu, Fujian (CN); Zhihao Xie, Fujian (CN); Duane Astel Lawrence, Fujian (CN); Fei Zheng, Fujian (CN); Libin Cao, Fujian (CN); Fuquan Ye, Fujian (CN); Ticheng Jiao, Fujian (CN); Yun Li, Fujian (CN); Shoudong Huang, Fujian (CN); Zheng Zhang, Fujian (CN); Quanshou Zeng, Fujian (CN); Fang Cheng, Fujian (CN); Wei Shen, Fujian (CN)

(73) Assignee: ANTA (CHINA) CO., LTD., Fujian (CN)

( * ) Notice: Subject to any disclaimer, the term of this patent is extended or adjusted under 35 U.S.C. 154(b) by 41 days.

(21) Appl. No.: 19/002,665

(22) Filed: Dec. 26, 2024

(65) Prior Publication Data

US 2026/0101963 A1 Apr. 16, 2026

(30) Foreign Application Priority Data

Oct. 11, 2024 (CN) ..... 202411418615.6

(51) Int. Cl.
*A43B 13/18* (2006.01)
*A43B 21/32* (2006.01)

(52) U.S. Cl.
CPC ..... *A43B 13/181* (2013.01); *A43B 21/32* (2013.01)

(58) Field of Classification Search
CPC ..... A43B 13/181; A43B 13/141; A43B 13/04; A43B 21/32
See application file for complete search history.

(56) References Cited

U.S. PATENT DOCUMENTS

| | | | | |
|---|---|---|---|---|
| 9,504,289 | B2 * | 11/2016 | Dojan | A43B 7/1435 |
| 2014/0259782 | A1 * | 9/2014 | Dojan | A43B 7/1435 |
| 2022/0031015 | A1 * | 2/2022 | Jenkins | A43B 13/16 |
| 2022/0142296 | A1 * | 5/2022 | Head | A43B 13/16 |

* cited by examiner

*Primary Examiner* — Haley A Smith
(74) *Attorney, Agent, or Firm* — JCIPRNET

(57) ABSTRACT

A shock-absorbing sole with upper and lower layered shearing and a shoe are provided. Each of an inner side surface of the sole and an outer side surface of the sole in a width direction is provided with a first groove extending in a length direction. A second groove is provided in a middle position of a bottom surface of the sole in the width direction and extends in the length direction. In the length direction of the sole, a width of a groove mouth of the first groove has a variation trend consistent with a thickness of the sole, and a width of a groove mouth of the second groove has a variation trend consistent with a width of the sole.

7 Claims, 11 Drawing Sheets

SHOCK-ABSORBING SOLE WITH UPPER AND LOWER LAYERED SHEARING AND SHOE

CROSS-REFERENCE TO RELATED APPLICATION

This application claims the priority benefit of China application serial no. 202411418615.6, filed on Oct. 11, 2024. The entirety of the above-mentioned patent application is hereby incorporated by reference herein and made a part of this specification.

BACKGROUND

Technical Field

The disclosure relates to the field of sole technology and specifically relates to a shock-absorbing sole with upper and lower layered shearing and a shoe.

Description of Related Art

At present, for shoes with shock-absorbing functions currently-available on the market, the shoes are improved in terms of the material and structure of the sole. For instance, in terms of sole material, foamed thermoplastic polyurethane material with improved shock-absorbing effect is used, or in terms of sole structure, structures such as air cushions and shock-absorbing columns are designed. Among these types of shoes, compared to improvements in sole materials, improvements in sole structure may more directly enhance the shock-absorbing performance of the sole. However, regarding the currently-available shock-absorbing soles, there are problems such as the overall wearing feeling being relatively hard and the wearing comfort being less favorable.

SUMMARY

The following is a brief description of the subject to be explained in detail in the specification, and the brief description is not intended to limit the protection scope of the claims.

The embodiments of the disclosure provide a shock-absorbing sole with upper and lower layered shearing and a shoe. Each of an inner side surface and an outer side surface of the sole in a width direction is provided with a first groove extending in a length direction. A second groove is provided in a middle position of a bottom surface of the sole in the width direction and extends in the length direction. In the length direction of the sole, a width of a groove mouth of the first groove has a variation trend consistent with a thickness of the sole, and a width of a groove mouth of the second groove has a variation trend consistent with a width of the sole.

BRIEF DESCRIPTION OF THE DRAWINGS

To make the technical solutions provided in the embodiments of the disclosure more clearly illustrated, several accompanying drawings required by the embodiments for description are briefly introduced as follows. Obviously, the drawings in the following description are only some embodiments of the disclosure, and for a person having ordinary skill in the art, other drawings can be obtained based on these drawings without inventive effort.

DESCRIPTION OF THE EMBODIMENTS

Figure 1:
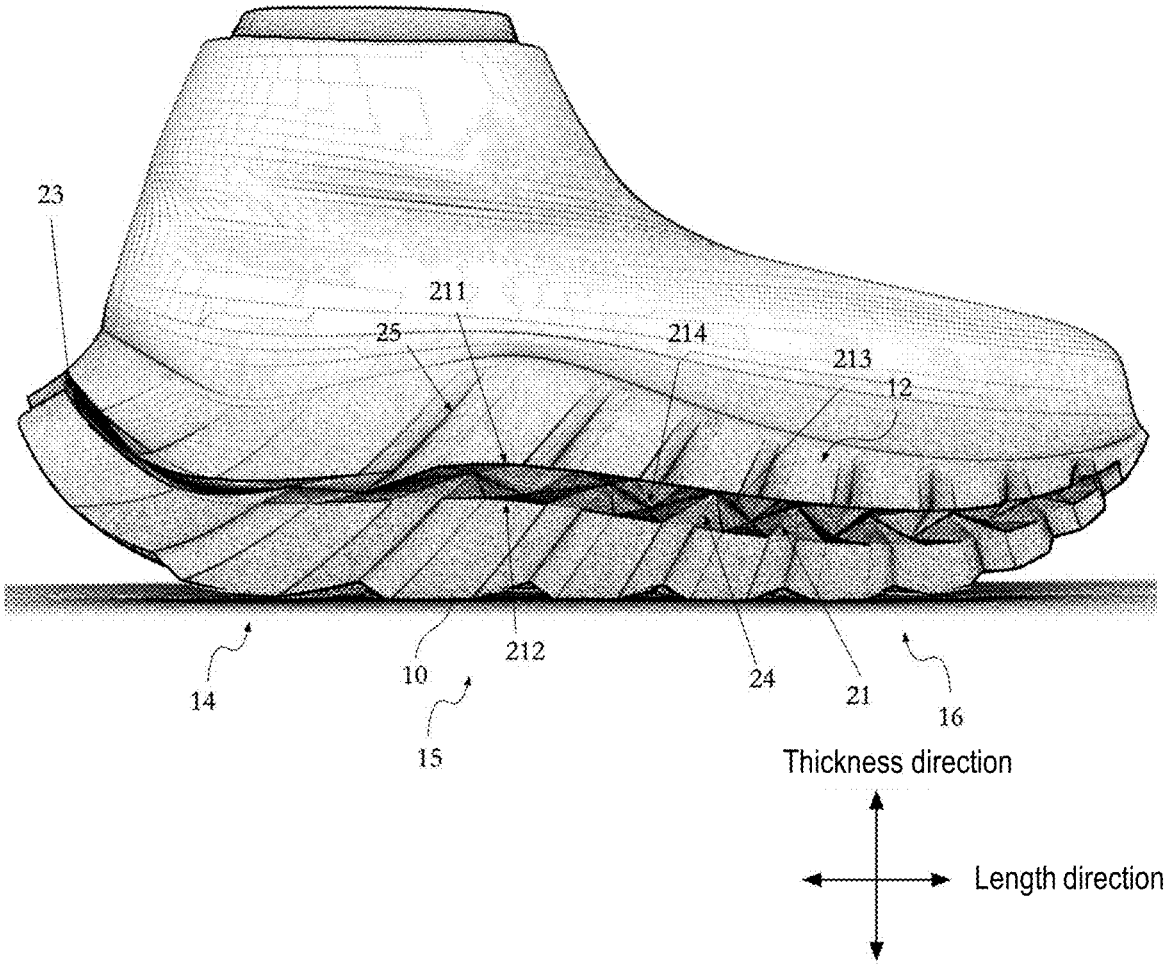
FIG. 1 is a structural schematic view of a side surface of a shoe provided by Embodiment 1 of the disclosure.

The accompanying drawings in the embodiments of the disclosure are included to provide a clear and complete description of the technical solutions provided in the embodiments of the disclosure. Obviously, the described embodiments are preferred embodiments of the disclosure, and should not be regarded as exclusion of other embodiments. Based on the embodiments of the disclosure, all other embodiments obtained by a person of ordinary skill in the art without making any inventive effort fall within the scope that the disclosure seeks to protect.

In the claims, specification, and above-mentioned drawings of the disclosure, unless otherwise clearly defined, the use of terms, such as "first", "second", "third" etc. are for distinguishing different objects rather than for describing a specific order.

In the claims, specification, and above-mentioned drawings of the disclosure, unless otherwise clearly defined, directional terms, such as the terms "central", "lateral", "longitudinal", "horizontal", "vertical", "top", "bottom", "inside", "outside", "up", "down", "front", "back", "left", "right", "clockwise", "counterclockwise", etc., indicating directions or positional relationships are based on directions and positional relationships shown in the drawings, and are only for convenience of describing the disclosure and simplifying the description, rather than indicating or implying that the device or element referred to must have a specific direction or be constructed and operated in a specific direction. Therefore, it cannot be understood as limiting the specific scope of the disclosure.

In the claims, specification, and above-mentioned drawings of the disclosure, unless otherwise clearly defined, if the term, if the term "fixedly connected" or "fixed connection" is used, it should be understood in a broad sense, that is, any connection method without a displacement relationship and relative rotation relationship between the two, that is to say, including non-detachable fixed connection, detachable fixed connection, integrated connection, and fixed connection through other devices or elements.

In the claims, specification, and above-mentioned drawings of the disclosure, if the terms, "including", "having", and variations thereof are used, they are intended to mean "including but not limited to".

Embodiment 1

With reference to FIG. 1, Embodiment 1 of the disclosure provides a shoe, and the shoe includes an upper and a sole 10 combined with the upper. The sole 10 is a shock-absorbing sole 10 with upper and lower layered shearing provided by this embodiment.

Herein, with reference to FIG. 1, the shock-absorbing sole 10 with upper and lower layered shearing provided by this embodiment includes sole components formed by processes such as foaming or thermoplastic molding. Based on the structural understanding of conventional soles 10, a person having ordinary skill in the art understand that the sole 10 has a width direction and a length direction. On both side surfaces of the sole 10 in the width direction, there are an inner side surface 11 and an outer side surface 12. Further, at a rear end position in the length direction of the sole 10 is a rear end side surface of the sole 10. It should be understood that at a front end position in the length direction of the sole 10, the sole 10 has a shape with gradually decreasing thickness, and therefore, the front end position of the sole 10 is not defined as a side surface.

Further, a person having ordinary skill in the art are familiar that, based on the corresponding relationship between the sole 10 and the foot, the sole 10 may be divided into a forefoot position 16, a mid-waist position 15, and a heel position 14 in the length direction. It should be understood that the forefoot position 16, the mid-waist position 15, and the heel position 14 mentioned herein are only rough divisions of different portions of the sole 10, and there are no strict dividing boundaries among the three.

In the sole 10 provided by this embodiment, each of the inner side surface 11 and an outer side surface 12 of the sole 10 in the width direction is provided with a first groove 21 extending in the length direction. A shape of this first groove 21 may be observed in FIG. 1, but FIG. 1 is only an outer side view of the sole 10. One first groove 21 is also provided on the inner side surface 11, which is not shown, of the sole 10. Further, with reference to FIG. 2, a second groove 22 is provided in a middle position of a bottom surface 13 of the sole 10 in the width direction and extends in the length direction.

Figure 2:
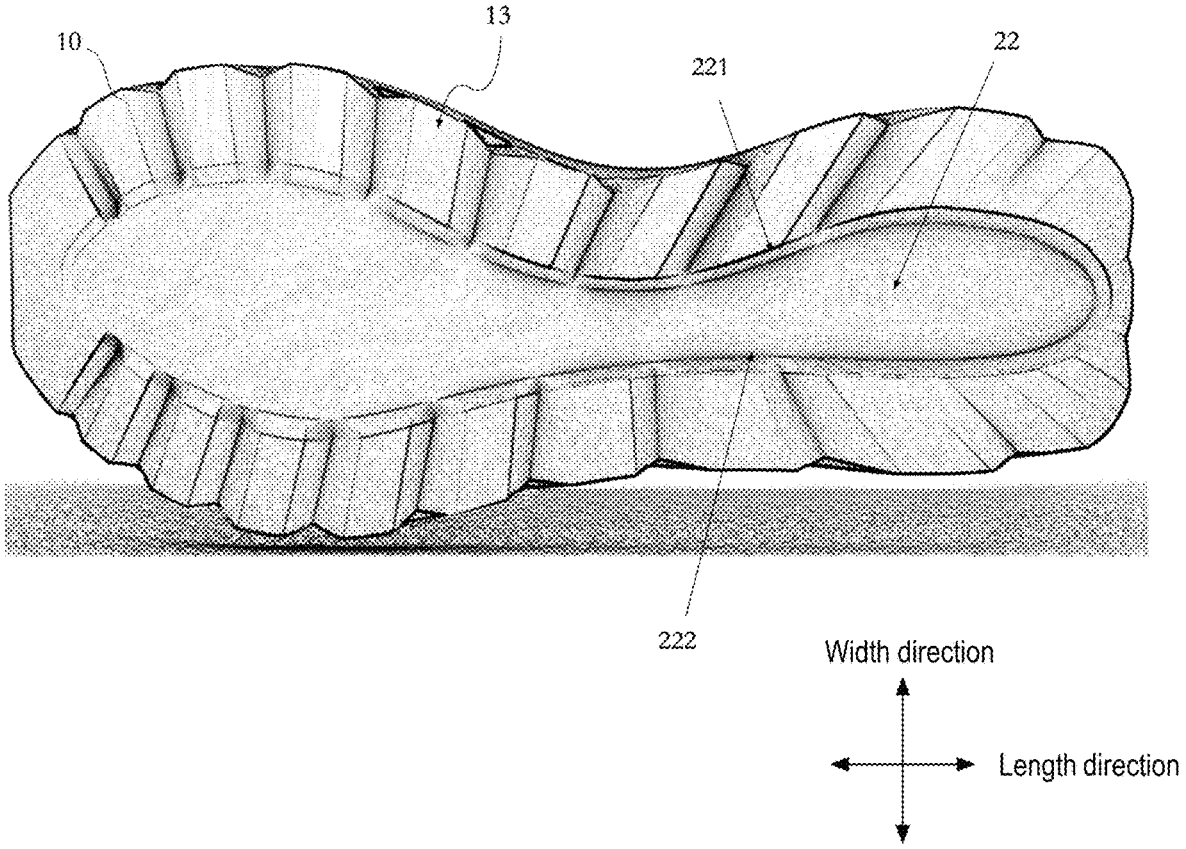
FIG. 2 is a structural schematic view of a bottom surface of the shoe provided by Embodiment 1 of the disclosure.

With reference to FIG. 1, edges of a groove mouth of the first groove 21 are a first edge 211 and a second edge 212. With reference to FIG. 2, edges of a groove mouth of the second groove 22 are a third edge 221 and a fourth edge 222. A distance between the first edge 211 and the second edge 212 is a width of the groove mouth of the first groove 21, and a distance from the first edge 211 and the second edge 212 to a groove bottom of the first groove 21 is a groove depth of the first groove 21. A distance between the third edge 221 and the fourth edge 222 is a width of the groove mouth of the second groove 22, and a distance from the third edge 221 and the fourth edge 222 to a groove bottom of the second groove 22 is a groove depth of the second groove 22.

With reference to FIG. 1 and FIG. 2, in the length direction of the sole 10, the width of the groove mouth of the first groove 21 has a variation trend consistent with a thickness of the sole 10, and the width of the groove mouth of the second groove 22 has a variation trend consistent with a width of the sole 10. It is easy to understand that the consistent variation trend mentioned herein means that the width of the groove mouth of the first groove 21 is set according to the thickness variation of the sole 10, and the width of the groove mouth of the second groove 22 is set according to the width variation of the sole 10. Herein, the thickness of the sole 10 refers to a thickness dimension of the sole 10 including a side wall, not the thickness dimension at a midline position in the width direction of the sole 10. Therefore, for a conventional sole 10, its thickness variation trend is generally thinnest at the forefoot position 16, followed by the heel position 14, and thickest at the mid-waist position 15. Correspondingly, the width of the groove mouth of the first groove 21 is also narrowest at the forefoot position 16, followed by the heel position 14, and widest at the mid-waist position 15. Similarly, the width variation trend of the sole 10 is generally widest at the forefoot position 16, followed by the heel position 14, and narrowest at the mid-waist position 15. Correspondingly, the width of the groove mouth of the second groove 22 is also widest at the forefoot position 16, followed by the heel position 14, and narrowest at the mid-waist position 15.

Figure 3:
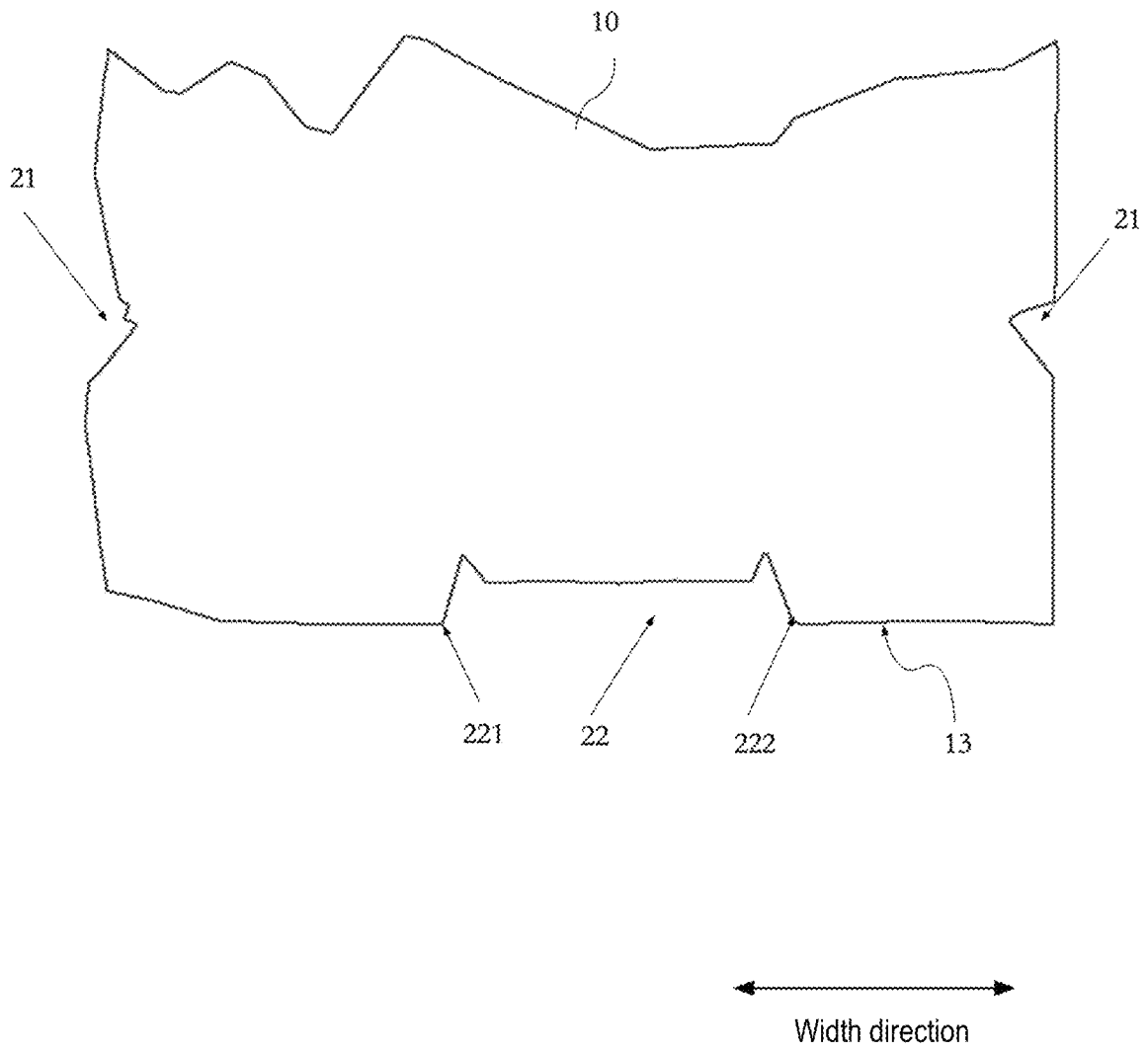
FIG. 3 is a cross-sectional schematic view of the shoe provided by Embodiment 1 of the disclosure when not under force.
Figure 4:
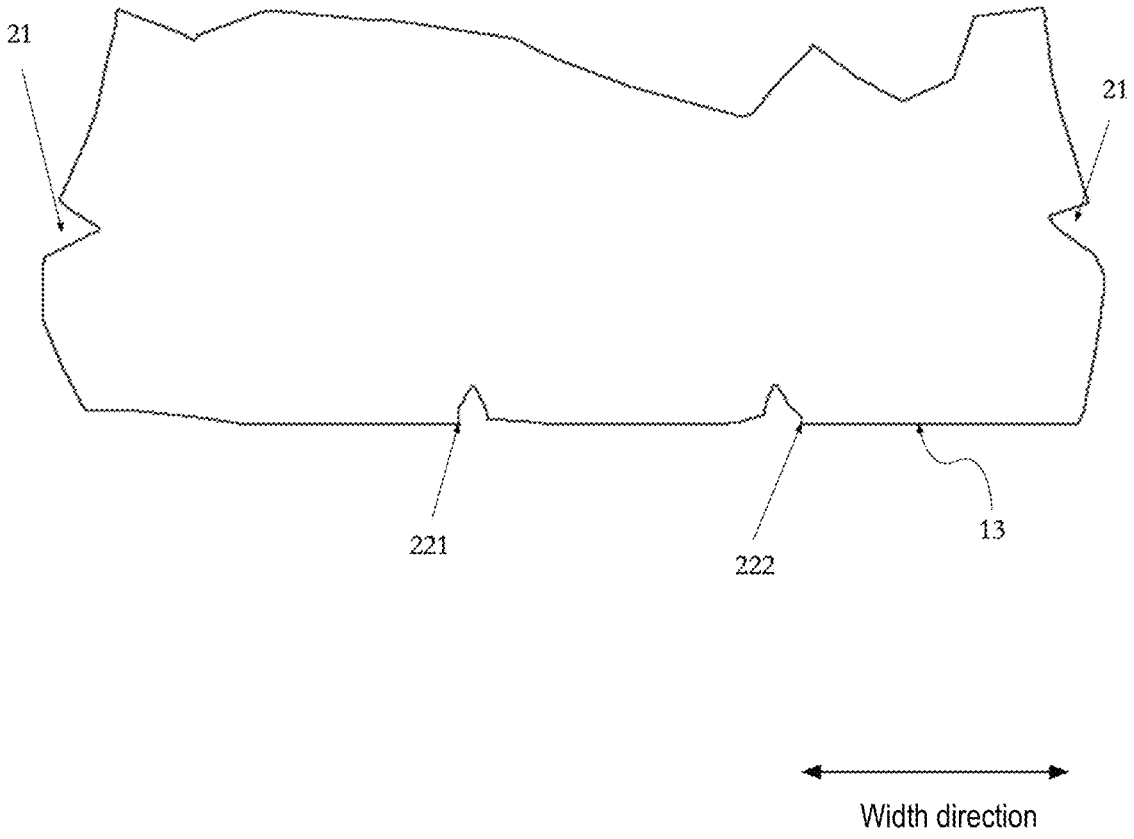
FIG. 4 is a cross-sectional schematic view of the shoe provided by Embodiment 1 of the disclosure when under force.
Figure 5:
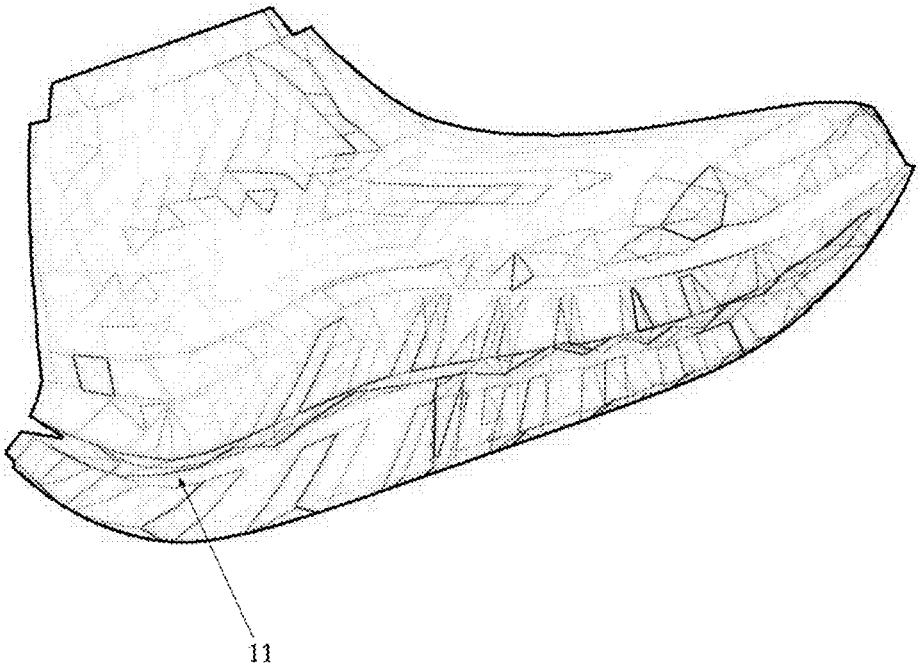
FIG. 5 is schematic view 1 of the side surface of the shoe provided by Embodiment 1 of the disclosure when stepping.
Figure 6:
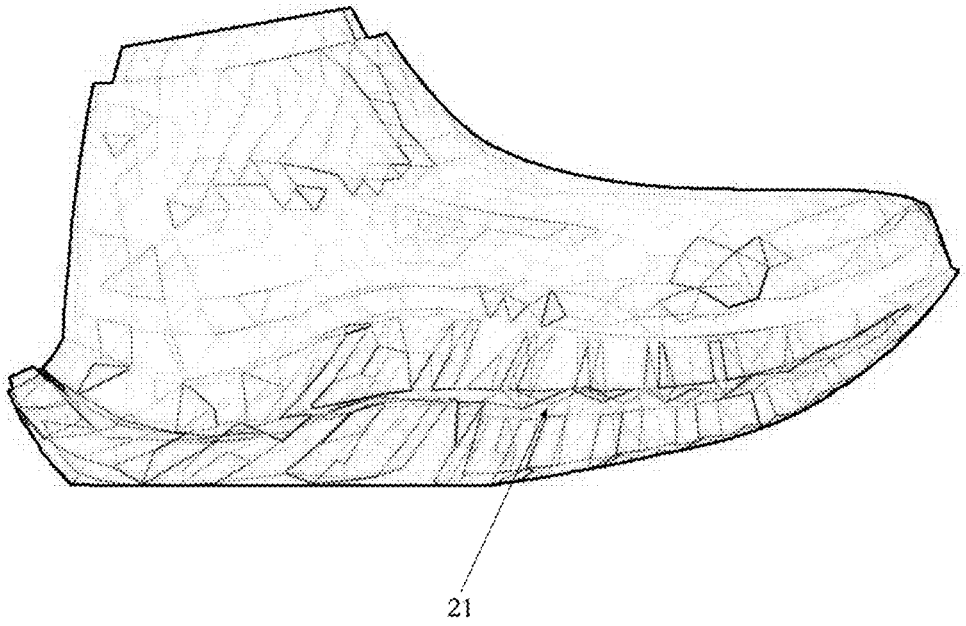
FIG. 6 is schematic view 2 of the side surface of the shoe provided by Embodiment 1 of the disclosure when stepping.
Figure 7:
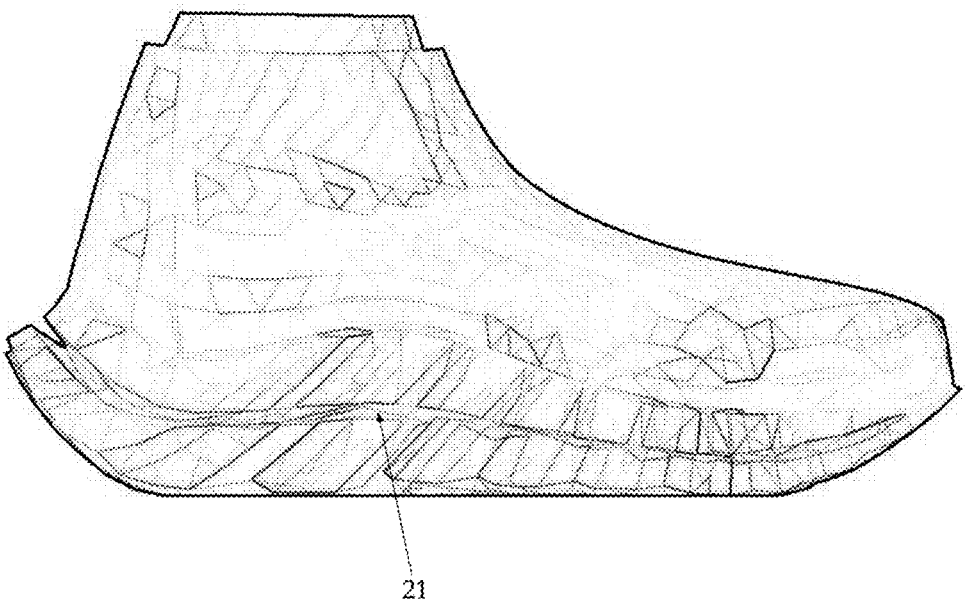
FIG. 7 is schematic view 3 of the side surface of the shoe provided by Embodiment 1 of the disclosure when stepping.

With reference to FIG. 1, a shape of the first groove 21 is featured by a small groove mouth width and a large groove depth, so that the sole 10 is divided into an upper side portion and a lower side portion through the first groove 21. The arrangement of the first groove 21 weakens the connection between the upper side portion and lower side portion of the sole 10 and affects the integrity of the upper side portion and lower side portion of the sole 10, so a greater degree of horizontal translation is allowed between the upper side portion and lower side portion of the sole 10. However, with only the arrangement of the first groove 21, the sole 10 may only experience a greater degree of horizontal translation between the upper side portion and the lower side portion when subjected to horizontal shear forces. As such, with reference to FIG. 2, the sole 10 in this embodiment has the second groove 22 arranged on the bottom surface 13. A shape of the second groove 22 is featured by a large groove mouth width and a small groove depth. With such an arrangement, when a user wears the shoe and walks or runs, the lower side portion of the sole 10 may first contact the ground. At this point, the state of the sole 10 may refer to FIG. 3, where the upper side portion and the lower side portion of the sole 10 have not yet deformed, and the friction between the bottom surface 13 of the sole 10 and the ground fixes the lower side portion of the sole 10 relative to its upper side portion on the ground. Due to the first groove 21 weakening the connection between the upper side portion and lower side portion of the sole 10, the upper side portion of the sole 10 may translate forward relative to its lower side portion. Next, with reference to FIG. 4, when the sole 10 is subjected to a vertical pressure, the second groove 22 arranged on the bottom surface 13 of the sole 10 allows the sole 10 to be flattened as a whole. The groove bottom of the second groove 22 may be closer to or directly in contact with the ground. Through the deformation of the second groove 22, the edges of the groove mouth of the first groove 21 come closer together, so that the relative sliding between the upper side portion and the lower side portion of the sole 10 is further increased. Further, the upper side portion and the lower side portion of the sole 10 also come closer together in a vertical direction, so that the overall shock-absorbing performance of the sole 10 is improved through the layered shearing of the upper side portion and the lower side portion of the sole 10. With reference to FIG. 5, FIG. 6, and FIG. 7, during one walking process, the upper side portion and the lower side portion of the sole 10 slide, while the first groove 21 changes from an open state to a closed state and then returns to the open state. During this process, the sole 10 provides sufficient shock-absorbing for the user's foot, so that comfort during walking and running is improved. In addition, the shock-absorbing structure design of this sole 10 also allows for improved foot feeling to the ground and reduced user fatigue when walking on uneven surfaces, such as mountain paths, through the relative sliding of the upper side portion and the lower side portion of the sole 10.

Herein, the widths of the groove mouths the first groove 21 and the second groove 22 may be made consistent with the variation trends of the thickness and width of the sole 10, ensuring that the degree of relative sliding between the upper side portion and the lower side portion of the sole 10 may remain consistent at various positions in the length direction of the sole 10. As such, insufficient sliding between the upper side portion and the lower side portion of the sole 10 at thicker positions of the sole 10 due to inadequate groove mouth width of the first groove 21 is avoided. Further, excessive sliding between the upper side portion and the lower side portion of the sole 10 at thinner positions of the sole 10 due to an excessively large groove mouth width of the first groove 21 is also avoided. This results in improved overall deformation of the sole 10 and improved shearing and shock-absorbing effect between the upper side portion and the lower side portion. Further, the relative sliding between the upper side portion and the lower side portion of the sole 10 has a strong correlation with the groove mouth width and the groove depth of the second groove 22. The second groove 22 shall have a relatively large groove mouth width and a deep groove depth, so that the sole 10 is allowed to be more easily flattened when subjected to a vertical pressure, and the relative sliding between the upper side portion and the lower side portion of the sole 10 is thereby increased. However, the groove depth of the second groove 22 shall be maintained within an appropriate range to ensure that the sole 10 has good supporting performance.

With reference to FIG. 1, the groove depth of the first groove 21 may be greatest at the mid-waist position 15 of the sole 10, and correspondingly, the groove depths of the first groove 21 at the forefoot position 16 and heel position 14 of the sole 10 may be smaller compared to that of the mid-waist position 15. With this arrangement, the upper side portion and the lower side portion of the sole 10 may have a larger deformation space at the mid-waist position 15, allowing relative sliding to still occur between the upper side portion and the lower side portion of the sole 10 when the sole 10 bends during stepping.

In addition, with reference to FIG. 1, a third groove 23 is provided on the rear end side surface in the length direction of the sole 10 and extends in the width direction. Two ends of the third groove 23 may be connected to the rear ends of the two first grooves 21 located on the inner side surface 11 and outer side surface 12 of the sole 10 respectively. The third groove 23 connects the first grooves 21 on both sides, so that a continuous groove structure is formed on the side surface portions of the sole 10, dividing uniformly the sole 10 from the heel to the forefoot position 16 into the upper side portion and the lower side portion. In this way, the pulling of a heel end surface on the upper side portion and the lower side portion of the sole 10 is reduced, and the relative sliding between the two is more obvious.

With reference to FIG. 1, upper and lower side groove walls of the first groove 21 extend obliquely toward each other from the position of the groove mouth and are butted at the midline position corresponding to the groove mouth. A shape of a butting line 213 of the upper and lower side groove walls of the first groove 21 on a projection plane perpendicular to the width direction is a broken line, and upper and lower edges of the groove mouth of the first groove 21 are relatively parallel curves with smooth transition in the length direction.

To be specific, the upper and lower side groove walls of the first groove 21 may not be relatively parallel structures, but rather relatively inclined structures. The groove bottom of the first groove 21 may not be a flat groove bottom shape as in a conventional groove structure, but rather a broken line shape formed by connecting the upper and lower side groove walls of the first groove 21. The broken line shape herein means that the shape of the butting line 213 formed by the upper and lower side groove walls of the first groove 21 at the groove bottom position on the projection plane perpendicular to the width direction of the sole 10 is a broken line shape. When observing the structure of this first groove 21 in practice, it may be seen that the groove walls of the first groove 21 form a plurality of triangle-shaped portions, with vertices of these triangular shapes being broken line vertices 214 in the butting line 213, and two sides of these triangular shapes extending outward from the broken line vertices 214 to the edge of the groove mouth of the first groove 21. Further, the triangular shapes of the upper and lower groove walls may be staggered, meaning that the triangular shapes in one side wall include relatively protruding portions and relatively recessed portions, with the triangular shapes of the protruding portions in the upper groove wall corresponding to the triangular shapes of the recessed portions in the lower groove wall, and vice versa.

Designing the butting line 213 as a broken line shape and designing the edges the groove mouth of the first groove 21 as smoothly transitioning parallel curves may, when the sole 10 is stepped on causing relative sliding between the upper side portion and the lower side portion of the sole 10, allow the broken line-shaped butting line 213 to make the upper side portion and the lower side portion of the sole 10 produce sliding deformation within a preset range at the position of the first groove 21. The upper side groove wall and the lower side groove wall of the first groove 21 may form a pushing and squeezing effect between each other, so that excessive sliding between the upper side portion and the lower side portion is avoided. Further, during sliding, the resistance experienced by the upper side portion at the first groove 21 may be fed back to the user's foot, so that the shock-absorbing performance of the sole 10 is improved.

Herein, at the vertex position of the broken line formed by the butting line 213 of the upper and lower side groove walls of the first groove 21, the groove wall on one side of the first groove 21 with a smaller angle corresponding to the vertex forms a fourth groove 24 connected to the vertex and extending to an edge of the groove mouth of the first groove 21. A fifth groove 25 connected to the fourth groove 24 and extending in the thickness direction is formed on the inner side surface 11 and/or outer side surface 12 of the sole 10.

To be specific, the fourth grooves 24 may also be arranged on the groove walls of the first groove 21, and the fifth grooves 25 may be arranged on both the inner side surface 11 and the outer side surface 12 of the sole 10. The fourth groove 24 and the fifth groove 25 may be matched to form an origami-like structure on the side surface of the sole 10. When relative sliding occurs between the upper side portion and the lower side portion of the sole 10, the two side walls of the fourth groove 24 and the fifth groove 25 may come closer to each other, so that the degree of sliding between the upper side portion and the lower side portion of the sole 10 is increased, and the shock-absorbing effect is further improved.

Embodiment 2

Figure 8:
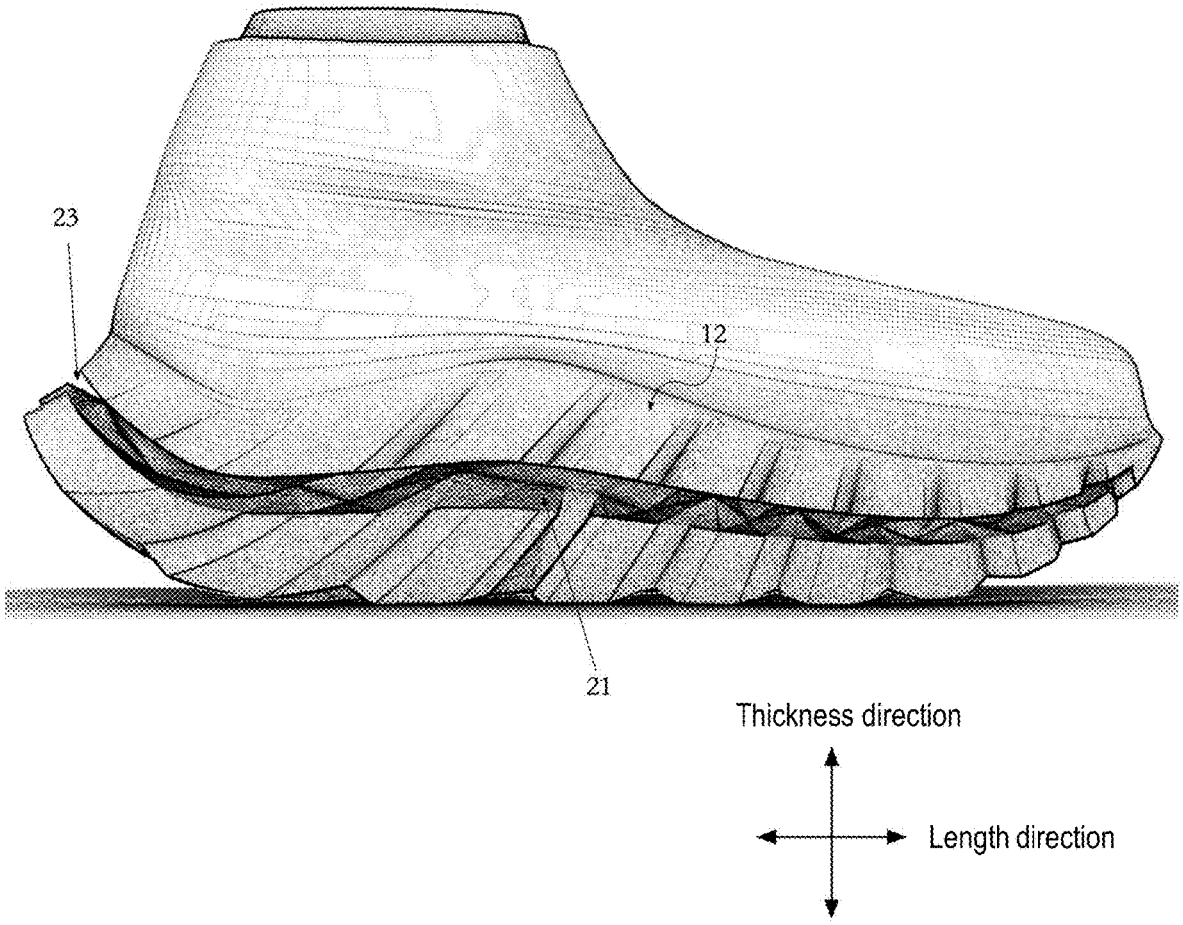
FIG. 8 is a structural schematic view of an outer side surface of a shoe provided by Embodiment 2 of the disclosure.
Figure 9:
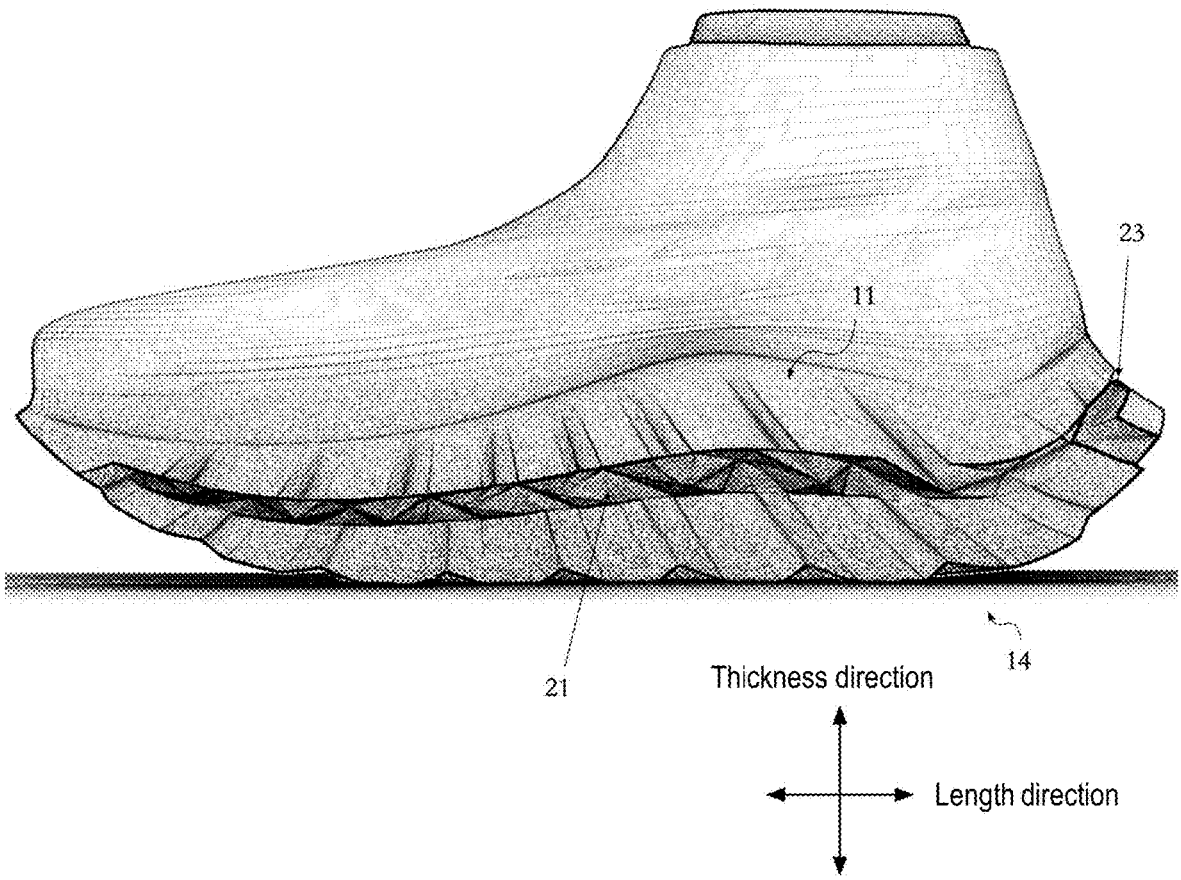
FIG. 9 is a structural schematic view of an inner side surface of the shoe provided by Embodiment 2 of the disclosure.

With reference to FIG. 8 and FIG. 9, in Embodiment 2, based on Embodiment 1, of the disclosure, targeted improvement is made to the groove depth of the first groove 21. In this embodiment, at the heel position 14 of the sole 10, the depth of the first groove 21 located on the inner side surface 11 may be less than the depth of the first groove 21 located on the outer side surface 12.

To be specific, with reference to FIG. 8, which is a schematic view of the outer side surface 12 of the shoe, and then with reference to FIG. 9, which is a schematic view of the inner side surface 11 of the shoe, observing the heel position 14 of the sole 10 in FIG. 8 and FIG. 9, it may be found that in the portion of the heel position 14, the groove depth of the first groove 21 located on the inner side surface 11 may be shallower, while the groove depth of the first groove 21 located on the outer side surface 12 may be deeper. Through such an arrangement, the supporting performance of the heel position 14 of the sole 10 may be improved through the shallower first groove 21 on the inner side surface 11, while the degree of sliding between the upper side portion and the lower side portion of the sole 10 is increased through the deeper first groove 21 on the outer side surface 12, so that the shock-absorbing effect is enhanced. Therefore, by arranging different groove depths for the first groove 21 on the outer side surface 12 and the inner side surface 11 of the sole 10, an improved balance between shock absorption and supporting performance may be achieved for the sole 10.

Embodiment 3

Figure 10:
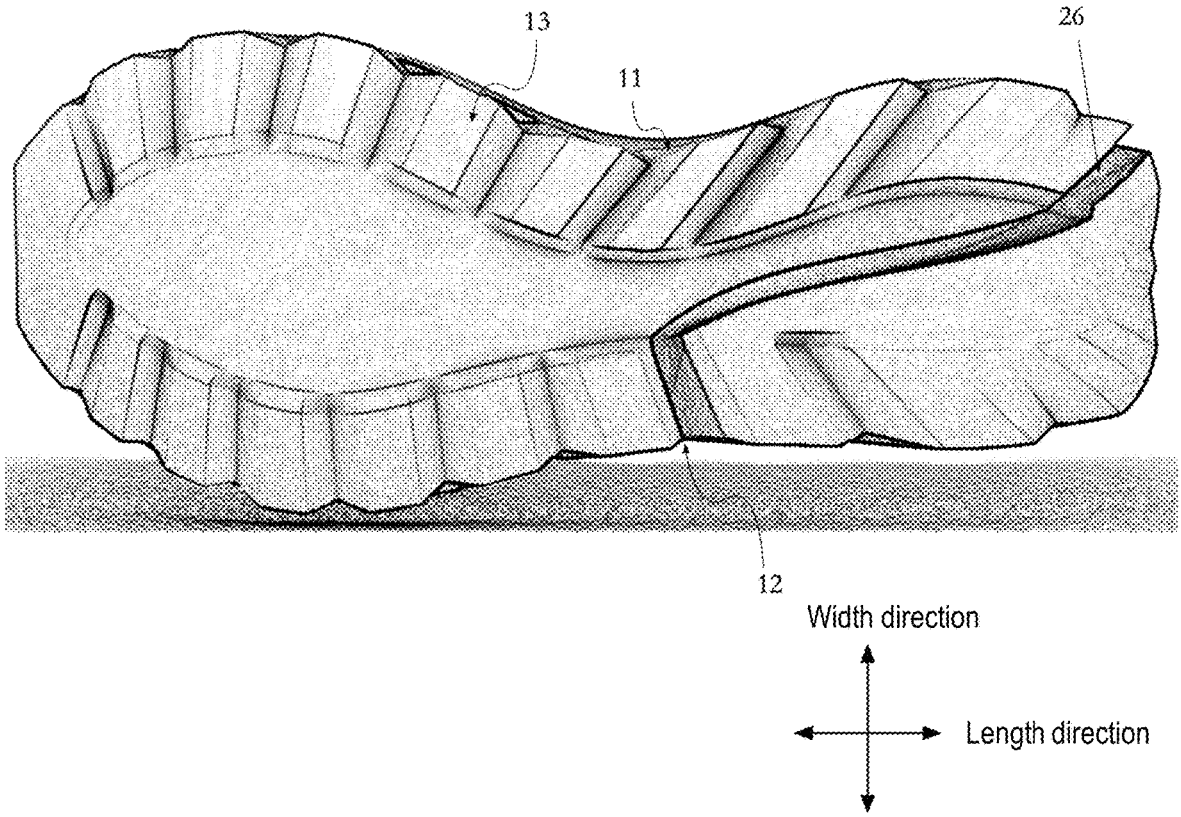
FIG. 10 is a structural schematic view of a bottom surface of a shoe provided by Embodiment 3 of the disclosure.

With reference to FIG. 10, in Embodiment 3, based on Embodiment 1 or Embodiment 2, of the disclosure, the structure of the bottom surface 13 of the sole 10 is improved. In this embodiment, the bottom surface 13 at the heel position 14 of the sole 10 may be provided with a sixth groove 26 with a depth greater than that of the second groove 22. The sixth groove 26 extends from the outer side surface 12 of the sole 10 to the middle position of the sole 10 in the width direction and extends backward to the rear end side surface of the sole 10.

To be specific, the sixth groove 26 forms an open end on the outer side surface 12 of the sole 10, with the position of this end at the mid-waist position 15 of the sole 10. After the sole 10 is cut at a slightly forward tilt angle, the sixth groove 26 extends to the fourth edge 222 of the second groove 22 on the sole 10, and then turns and extends obliquely toward the rear side of the sole 10, until it reaches the rear side end surface of the sole 10 and forms another open end on the rear side end surface of the sole 10. This end is located at a position on the rear side end surface of the sole 10 close to the inner side surface 11 of the sole 10. With such an arrangement, when the sole 10 is stepped on, it may have a higher degree of deformation, so the degree of closure of the first groove 21 and the degree of relative sliding between the upper side portion and the lower side portion of the sole 10 are increased, and the shock-absorbing performance of the sole 10 is thus further improved.

Embodiment 4

Figure 11:
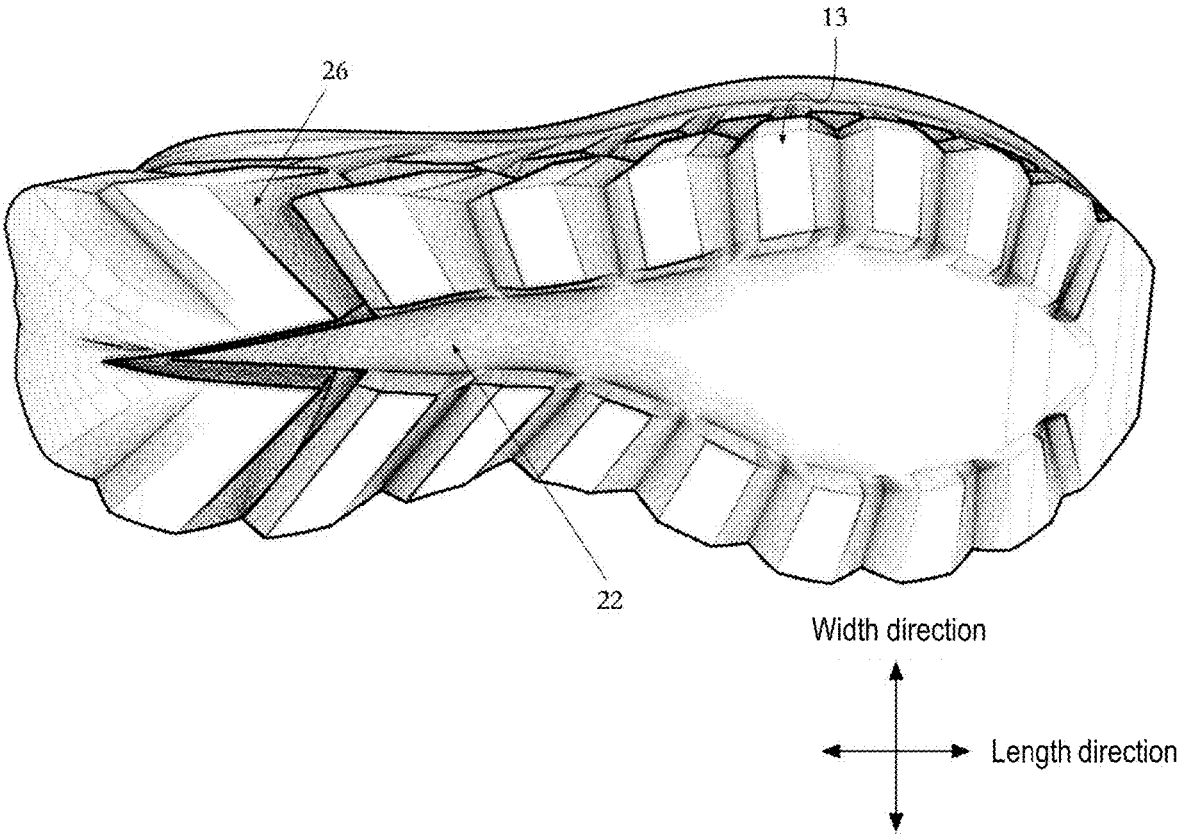
FIG. 11 is a structural schematic view of a bottom surface of a shoe provided by Embodiment 4 of the disclosure.

With reference to FIG. 11, in Embodiment 4, based on Embodiment 1 or Embodiment 2, of the disclosure, the structure of the bottom surface 13 of the sole 10 is improved. In this embodiment, the bottom surface 13 at the heel position 14 of the sole 10 may be provided with a sixth groove 26 with a depth greater than that of the second groove 22. The sixth groove 26 extends from the outer side surface 12 of the sole 10 to the inner side surface 11 and bends backward in the middle position of the sole 10 in the width direction.

To be specific, the sixth groove 26 forms an open end on the outer side surface 12 of the sole 10, with the position of this end at a portion of the heel position 14 of the sole 10 close to the mid-waist position 15. After the sole 10 is cut at a slightly forward tilt angle, the sixth groove 26 extends to the fourth edge 222 of the second groove 22 on the sole 10, and then turns and extends obliquely toward the rear side of the sole 10, turns back at the midline position of the sole 10 in the width direction to extend obliquely toward the front side of the sole 10 until it reaches the third edge 221 of the second groove 22, then turns again at a slightly backward oblique angle to continue extending until it reaches the inner side surface of the sole 10, and forms another open end on the inner side surface 11 of the sole 10. This end is located in the middle portion of the heel portion 14 of the sole 10. With such an arrangement, when the sole 10 is stepped on, it may have a higher degree of deformation, so the degree of closure of the first groove 21 and the degree of relative sliding between the upper side portion and the lower side portion of the sole 10 are increased, and the shock-absorbing performance of the sole 10 is thus further improved.

Although the description of the specification and embodiments provided above serve to explain the scope of the disclosure, such description should not be construed as limitations on the scope of the disclosure. Through inspiration provided by the disclosure or the embodiments, modifications, equivalents, or other improvements of the embodiments or part of the technical features of the disclosure obtained by a person having ordinary skill in the art by combining general knowledge and common technical knowledge in the art and/or related art through logical analyses, reasoning, or limited tests fall within the protection scope of the disclosure.

What is claimed is:

1. A shock-absorbing sole with upper and lower layered shearing, wherein each of an inner side surface of the sole and an outer side surface of the sole in a width direction is provided with a first groove extending in a length direction, and a second groove is provided in a middle position of a bottom surface of the sole in the width direction and extends in the length direction, in the length direction of the sole, a width of a groove mouth of the first groove has a variation trend consistent with a thickness of the sole, and a width of a groove mouth of the second groove has an another variation trend consistent with a width of the sole, wherein an upper side groove wall of the first groove and a lower side groove wall of the first groove extend obliquely toward each other from a position of the groove mouth and are butted at a midline position between an upper edge of the groove mouth of the first groove and a lower edge of the groove mouth of the first groove, wherein a shape of a butting line of the upper and lower side groove walls of the first groove on a projection plane perpendicular to the width direction is a broken line, and the upper edge of the groove mouth of the first groove and the lower edge of the groove mouth of the first groove are curved without any angular bends and follow the same shape in the length direction, wherein at a position of a vertex of the broken line formed by the butting line of the upper and lower side groove walls corresponding to the first groove, the groove wall on one side of the first groove forms a fourth groove connected to the vertex and extending to an edge of the groove mouth of the first groove, and a fifth groove connected to the fourth groove and extending in a thickness direction is formed on the inner side surface of the sole or outer side surface of the sole, the fifth groove is located outside the first groove.

2. The shock-absorbing sole with upper and lower layered shearing according to claim 1, wherein a groove depth of the first groove is the largest at a mid-waist position of the sole.

3. The shock-absorbing sole with upper and lower layered shearing according to claim 1, wherein at a heel position of the sole, a depth of the first groove located on the inner side surface is less than a depth of the first groove located on the outer side surface.

4. The shock-absorbing sole with upper and lower layered shearing according to claim 1, wherein a third groove is provided on a rear end side surface in the length direction of the sole and extending in the width direction, and two ends of the third groove are connected to rear ends of the two first grooves located on the inner side surface of the sole and outer side surface of the sole.

5. The shock-absorbing sole with upper and lower layered shearing according to claim 1, wherein the bottom surface at a heel position of the sole is provided with a sixth groove with a depth greater than a depth of the second groove, and the sixth groove extends from the outer side surface of the sole to the middle position of the sole in the width direction and extends backward to a rear end side surface of the sole.

6. The shock-absorbing sole with upper and lower layered shearing according to claim 1, wherein the bottom surface at a heel position of the sole is provided with a sixth groove with a depth greater than a depth of the second groove, and the sixth groove extends from the outer side surface of the sole to the inner side surface of the sole and extends backward in the middle position of the sole in the width direction.

7. A shoe comprising the shock-absorbing sole with upper and lower layered shearing according to claim 1.

* * * * *